US006691929B1

(12) United States Patent
Sherikar

(10) Patent No.: US 6,691,929 B1
(45) Date of Patent: Feb. 17, 2004

(54) CLOSED-VORTEX-ASSISTED DESUPERHEATER

(75) Inventor: Sanjay V. Sherikar, Mission Viejo, CA (US)

(73) Assignee: Control Components, Inc., Rancho Santa Margarita, CA (US)

( * ) Notice: Subject to any disclaimer, the term of this patent is extended or adjusted under 35 U.S.C. 154(b) by 0 days.

(21) Appl. No.: 10/375,962

(22) Filed: Feb. 28, 2003

(51) Int. Cl.[7] ..... B05B 15/00
(52) U.S. Cl. ..... 239/132.3; 239/398; 239/461
(58) Field of Search ..... 239/398, 399, 239/432, 434, 461, 463, 467, 468, 487, 488, 489, 490, 504, 518, 520

(56) References Cited

U.S. PATENT DOCUMENTS

| | | | | |
|---|---|---|---|---|
| 3,732,851 A | | 5/1973 | Self | |
| 4,442,047 A | | 4/1984 | Johnson | |
| 4,512,520 A | | 4/1985 | Schoonover | |
| 5,336,451 A | | 8/1994 | Lovick | |
| 5,351,477 A | * | 10/1994 | Joshi et al. | 60/39.463 |
| 5,385,121 A | | 1/1995 | Feiss | |
| 5,607,626 A | | 3/1997 | Kunkle et al. | |

FOREIGN PATENT DOCUMENTS

| | | | | |
|---|---|---|---|---|
| JP | 11082919 A | * | 3/1999 | F22G/5/12 |

* cited by examiner

*Primary Examiner*—Thomas Denion
*Assistant Examiner*—Zelalem Eshete
(74) *Attorney, Agent, or Firm*—Stetina Brunda Garred & Brucker

(57) ABSTRACT

There is provided a vortex generator comprised of a diffuser, a vortex ring and a spray nozzle. The diffuser redirects a flow of superheated steam radially outwardly by forcing the superheated steam through orifices. An end plate creates a low pressure area downstream of the diffuser. The vortex ring imparts a spiraling motion to the flow of superheated steam. The spray nozzle sprays cooling water in a predetermined spray pattern into the low pressure area. The spray pattern maximizes the surface area of the cooling water within the superheated steam. The combination of the spiraling motion, the radially outwardly directed flow, and the low pressure area results in a closed vortex having a vortex core. The closed vortex is characterized as a spiraling, swirling flow of eddies and vortices downstream of the vortex generator. The closed vortex promotes the uniform mixing of the cooling water with the steam flow.

13 Claims, 1 Drawing Sheet

CLOSED-VORTEX-ASSISTED DESUPERHEATER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention pertains generally to steam desuperheaters and, more particularly, to a vortex generator of a steam desuperheater for reducing steam temperature by generating a closed vortex within a flow of superheated steam passing through a steam pipe and spraying the steam flow with cooling water.

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a point near its saturation temperature, thereby increasing the system thermal efficiency, ensuring system protection, and correcting for unintentional amounts of superheat.

Conventional steam desuperheaters can lower the temperature of superheated steam by spraying cooling water into a steam pipe through a spray nozzle mounted on the wall of the steam pipe. The cooling water is sprayed into a flow of superheated steam that is passing through the steam pipe. Once the cooling water is sprayed into the flow of superheated steam, the cooling water mixes with the superheated steam and evaporates, drawing thermal energy from the steam and lowering its temperature. Ideally, the cooling water spray will enter the steam pipe as very fine water droplets in a spray pattern that will penetrate through the width of the steam pipe and evenly mix with the superheated steam flow. However, if the steam flow has a low velocity or if the cooling water spray is comprised of relatively large water droplets, then the cooling water spray may pass through the steam flow and impinge upon the opposite interior wall of the steam pipe. The resulting dispersion and mixing of the cooling water with the superheated steam flow is poor, resulting in a greatly diminished evaporation rate of the cooling water and an uneven and poorly controlled temperature reduction throughout the flow of the superheated steam. In addition, an impinging cooling water spray may result in water buildup on the interior wall of the steam pipe. This water buildup can cause erosion and thermal stresses in the steam pipe as the wall of the steam pipe can reach upwards of 1000° F. Such thermal stresses may lead to structural failure of the steam pipe and other components. Furthermore, the accumulation of cooling water on the interior wall of the steam pipe will eventually evaporate in a non-uniform heat exchange between the water and the superheated steam, resulting in a poorly controlled temperature reduction. Finally, even if the cooling water spray does not impinge on the opposite wall of the steam pipe, the length of time for evaporation may be increased if the cooling water spray is comprised of large water droplets. This is because larger water droplets may have a longer evaporation time as compared to the evaporation time for smaller or finer water droplets. As a result of the increased evaporation time for the larger water droplets, the superheated steam must travel a longer distance in the steam pipe before achieving a uniform temperature reduction.

Various desuperheating devices have been developed to overcome these problems. One such prior art desuperheating device attempts to avoid these problems by spraying cooling water into the steam pipe at an angle to avoid impinging the walls of the steam pipe. However, the construction of this device is complex with many parts such that the device has a high construction cost. Another prior art desuperheating device utilizes a spray nozzle positioned in the center of the steam pipe with multiple nozzles and a moving plug or slide member uncovering an increasing number of nozzles. Each of the nozzles is in fluid communication with a cooling water source. Although this desuperheating device may eliminate the impingement of the cooling water spray on the steam pipe walls, such a device is necessarily complex, costly to manufacture and install and requires a high degree of maintenance after installation.

As can be seen, there exists a need in the art for a desuperheating device capable of increasing the velocity of the flow of superheated steam such that cooling water spray will not impinge on the walls of the steam pipe. Furthermore, there exists a need in the art for a desuperheating device capable of creating turbulent flow adjacent the cooling water spray nozzle to promote the uniform mixing of the cooling water with the superheated steam. Additionally, there exists a need in the art for a desuperheating device capable of increasing the velocity of the flow of superheated steam for more effective evaporation of cooling water sprayed into the steam pipe. Finally, there exists a need in the art for a desuperheating device for spraying cooling water into a flow of superheated steam that is of simple construction with relatively few components and requiring low maintenance.

SUMMARY OF THE INVENTION

The present invention specifically addresses and alleviates the above referenced deficiencies associated with steam desuperheaters. More particularly, the present invention is a vortex generator of a desuperheating device for generating a closed vortex within a flow of superheated steam passing through a steam pipe.

The vortex generator is configured to increase the velocity of the flow of superheated steam within a closed vortex and subsequently generates vortices and eddies in a recirculation zone. The vortices and eddies improve the mixing of the cooling water spray within the superheated steam. This feature is especially beneficial if the cooling water spray is comprised of relatively large water droplets because larger water droplets tend to penetrate deeper across the flow of superheated steam. However, because of the vortices and eddies within the closed vortex, the larger water droplets are captured and may then undergo evaporation due to the increased residence time of the water droplets within the closed vortex. The vortex generator is comprised of a diffuser, a vortex ring and a spray nozzle. The diffuser and the steam pipe together define an annular chamber within which is disposed the vortex ring. The diffuser increases the velocity of the superheated steam by forcing the flow of superheated steam through an array of orifices formed in a barrel section. An end plate seals the barrel section such that superheated steam must pass through the orifices. The end plate also creates an area of low pressure downstream of the diffuser which helps to create a swirling flow of superheated steam.

The vortex ring is disposed within the annular chamber at the downstream end of the barrel section and is configured to impart a spiraling motion to the flow of superheated steam that is exiting the annular chamber. The combination of the spiraling motion imparted to the superheated steam by the vortex ring, the increased velocity produced by the diffuser, and the low pressure area created by the end plate results in a spiraling, swirling flow of eddies and vortices in the low pressure area or recirculation zone. A spray nozzle mounted on the steam pipe sprays cooling water into the flow of superheated steam. The spray nozzle may be regulated by a control valve which may vary the rate of cooling water flowing out of the spray nozzle. Ideally, the spray nozzle is positioned such that the cooling water is sprayed directly into the low pressure area where the superheated steam is in a spiraling, swirling flow of eddies and vortices. The spray nozzle causes the cooling water to enter the steam pipe in a pattern of spray consisting of very small water droplets. The spray pattern maximizes the surface area of the cooling water spray, permitting more effective evaporation of the cooling water. This spray pattern promotes the uniform mixing of the cooling water with the steam flow and thus optimizes the desuperheating effect per unit mass of cooling water.

BRIEF DESCRIPTION OF THE DRAWINGS

These as well as other features of the present invention will become more apparent upon reference to the drawings wherein.

DETAILED DESCRIPTION OF THE INVENTION

The present invention will now be described in particular with reference to the accompanying drawings.

Figure 2:
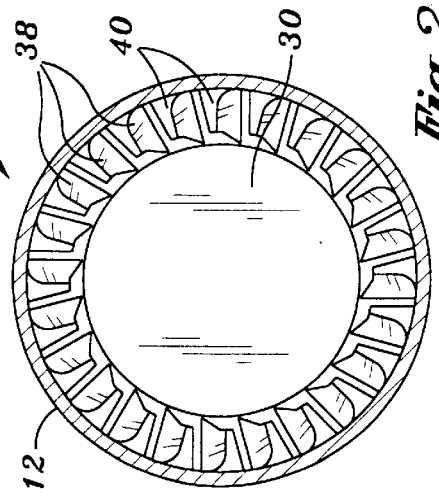
FIG. 2 is an axial sectional view of the desuperheating device taken along line 2—2 of FIG. 1 illustrating a vortex ring and a diffuser end plate disposed within a steam pipe.
Figure 1:
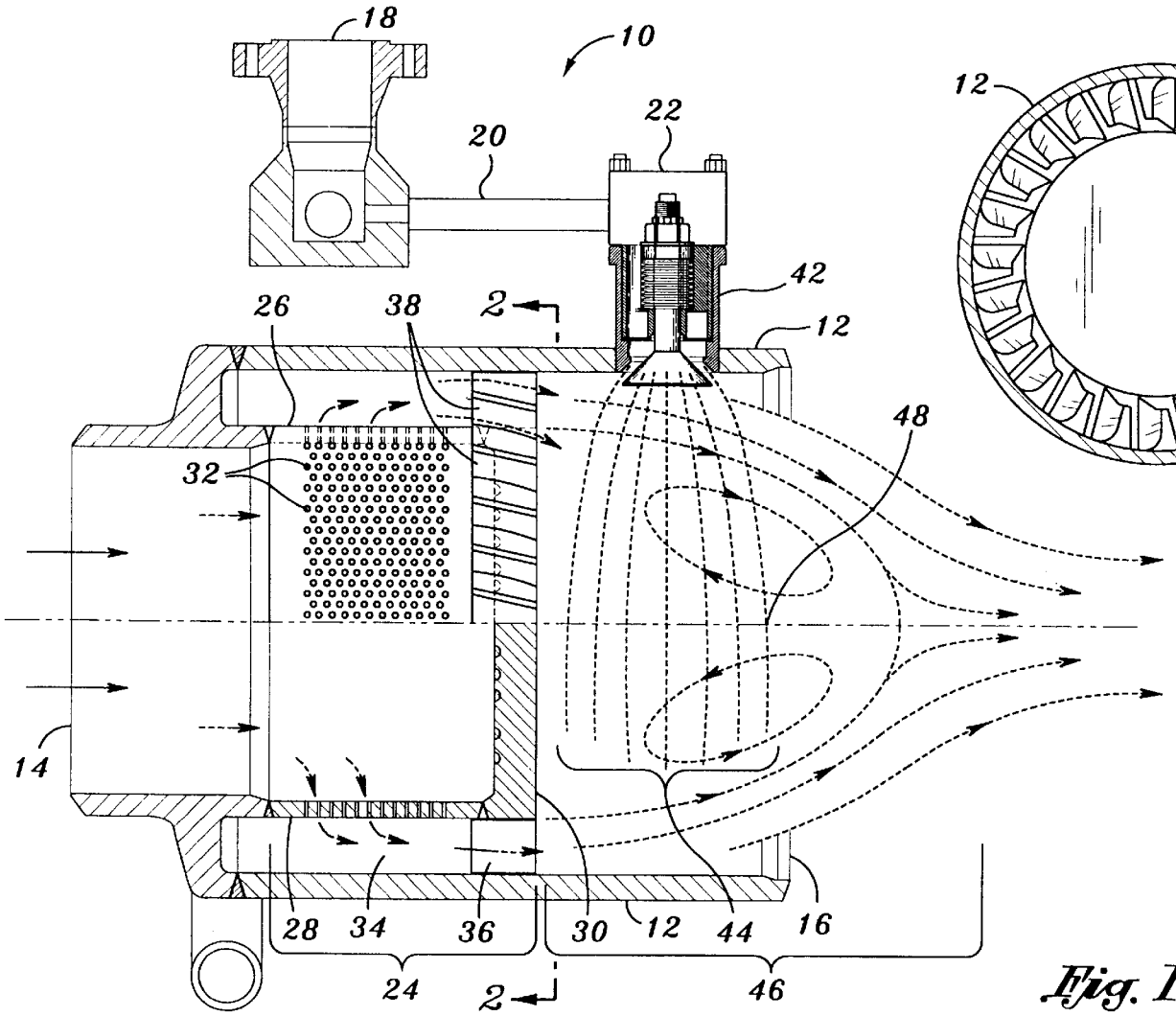
FIG. 1 is longitudinal sectional view of a desuperheating device incorporating a vortex generator of the present invention.

FIG. 1 is longitudinal sectional view of a desuperheating device 10 incorporating a vortex generator 24 of the present invention. FIG. 2 is an axial sectional view of the desuperheating device 10 taken along line 2—2 of FIG. 1 illustrating a vortex ring 36 and a diffuser end plate 30 disposed within a steam pipe 12. The vortex generator 24 is configured to redirect the flow of superheated steam radially outwardly, increase the velocity of the flow of superheated steam and subsequently generate a closed vortex 46 within the flow for improved mixing of the cooling water spray within the superheated steam. The vortex generator 24 is comprised of a diffuser 26, the vortex ring 36 and a spray nozzle 42. As can be seen in FIG. 1, the desuperheating device 10 includes the steam pipe 12 having a steam inlet 14 and a steam outlet 16. The diffuser 26 and the steam pipe 12 define an annular chamber 34 therebetween. The diffuser 26 is configured to redirect the flow of superheated steam from the center of the steam pipe 12 radially outwardly into the annular chamber 34. During the redirection of the steam flow, the diffuser 26 may also locally increase the velocity of the superheated steam as compared to the velocity of the steam flow at the steam inlet 14. The diffuser 26 may include a barrel section 28 and the end plate 30. As shown in FIGS. 1 and 2, the barrel section 28 has an elongate cylindrical shape which is open at the end adjacent the steam inlet 14 and sealed on the opposite end by the end plate 30. The end plate 30 may be configured with a concave or convex shape, or any number of alternate shapes and configurations designed to optimize the generation of vortices and eddies. Furthermore, it is contemplated that the barrel section 28 may be of any shape or configuration that can receive the flow of superheated steam.

Importantly, the barrel section 28 has a plurality of orifices 32 formed thereabout. The orifices 32 restrict the flow of superheated steam from the interior of the diffuser 26 into the annular chamber 34. The superheated steam will locally increase in velocity as it passes through the orifices 32. The end plate 30 seals the barrel section 28 and forces the flow of superheated steam to pass through the orifices 32 of the barrel section 28. The outer circumference of the end plate 30 may be configured to approximately match that of the barrel section 28. The end plate 30 creates a low pressure area 44 in the location immediately adjacent the exterior side of the end plate 30. As will be explained in more detail below, this low pressure area 44 helps to create a swirling flow of superheated steam at a vortex core 48 of the closed vortex 46. The low pressure area 44 improves subsequent mixing and recirculation of cooling water with the superheated steam. The orifices 32 may be disposed such that they radially extend through the barrel section 28. The orifices 32 serve to allow the passage of superheated steam from the interior of the diffuser 26 into the annular chamber 34. Although the orifices 32 may be randomly arranged in the barrel section 28, it is contemplated that the orifices 32 may be arranged in a plurality of rows extending axially along a length of the barrel section 28, as shown in FIG. 1. Alternately, the rows may be circumferentially spaced apart, with each orifice 32 in a row being substantially aligned in the axial direction with the orifice 32 in an adjacent row. In a further arrangement, the rows may be circumferentially spaced apart, with each orifice 32 in a row offset in the axial direction from the orifice 32 in an adjacent row. The orifices 32 may be of substantially identical circular shape, as shown in FIG. 1. It is recognized herein that there are many shapes, sizes, configurations and quantities of orifices 32 that may be incorporated within the barrel section 28 so that the desired steam flow characteristics into the annular chamber 34 are provided.

The vortex ring 36 is concentrically disposed within the annular chamber 34 at the downstream end of the barrel section 28. The vortex ring 36 may have an annular shape such that the inner and outer diameter thereof are in respective abutting contact with the end plate 30 and the interior surface of the steam pipe 12 as shown in FIG. 2. The vortex ring 36 may be rigidly mounted to either the barrel section 28, the steam pipe 12, or to both, by suitable means such as welding or with removable fasteners. The vortex ring 36 may be disposed proximate the end plate 30 such that the end plate 30 is co-planar with the vortex ring 36. Advantageously, the vortex ring 36 is configured to impart a spiraling motion to the flow of superheated steam that is exiting the annular chamber 34. The vortex ring 36 may include vanes 38 for imparting the spiraling motion, the vanes 38 formed circularly around the vortex ring 36. The vanes 38 may extend radially from the exterior diameter of the barrel section 28 to the steam pipe 12. The end plate 30 may be disposed slightly downstream of the vortex ring 36 and vanes 38. The vanes 38, the steam pipe 12 and the barrel section 28 collectively define corresponding channels 40 configured to impart a spiraling motion to the superheated steam such that the superheated steam exiting the annular chamber 34 defines a helical path. As will explained in more detail below, the combination of the spiraling motion imparted to the superheated steam by the vortex ring 36, the radially outwardly directed flow having increased velocity as produced by the diffuser 26, and the low pressure area 44 created by the end plate 30 results in the creation of the closed vortex 46. The closed vortex 46 is characterized as a spiraling, swirling flow of eddies and vortices adjacent the low pressure area 44. The swirling flow advantageously improves the mixing of the cooling water with the superheated steam due to the increased residence time of the cooling water.

As shown in FIG. 1, the spray nozzle 42 is mounted on the steam pipe 12 proximate the vortex ring 36 by suitable means such as welding or the like. The spray nozzle 42 sprays cooling water into the flow of superheated steam. A nozzle holder 22 connects a cooling water feedline 20 to the spray nozzle 42 for providing a suitable supply of cooling water thereto. The cooling water feedline 20 is connected to a cooling water control valve 18. The cooling water control valve 18 may be fluidly connected to a suitable high pressure water supply (not shown). The control valve 18 may operate to control the flow of cooling water into the cooling water feedline 20 in response to a signal from a temperature sensor (not shown) mounted in the steam pipe 12 downstream of the vortex generator 24. The control valve 18 may vary the cooling water flow through the cooling water feedline 20 in order to produce a varying flow rate of cooling water out of the spray nozzle 42.

The spray nozzle 42 is shown in FIG. 1 disposed proximate the vortex ring 36 and the end plate 30. Ideally, it is contemplated that the spray nozzle 42 is positioned relative to the vortex generator 24 such that large droplets of cooling water spray exiting the spray nozzle 42 may flow directly into the low pressure area 44 at the vortex core 48 of the closed vortex 46 where the superheated steam is in a spiraling, swirling flow of eddies and vortices. In this regard, the spray nozzle 42 may be disposed approximately midway between the vortex ring 36 and an end of the closed vortex 46, as shown in FIG. 1. However, the spray nozzle 42 may be disposed at any suitable position along the steam pipe 12. The spray nozzle 42 is configured to spray cooling water into the flow of superheated steam with the intent of ultimately effecting a reduction in the superheated steam temperature. Toward this end, the spray nozzle 42 may be configured to impart a predetermined spray pattern to the cooling water. The predetermined spray pattern may have a conical shape or the spray pattern may have a flat fan pattern. The predetermined spray pattern may cause the cooling water to enter the steam pipe 12 as small water droplets. The spray pattern maximizes the surface area of the cooling water spray, permitting more effective evaporation of the cooling water. Alternately, the spray nozzle 42 may be configured to impart a conical, spiraling motion to the spray pattern such that the cooling water exiting the spray nozzle 42 defines an expanding helical path. The expanding helical path causes the cooling water to enter the steam flow as a swirling cone-shaped mist spray. Such a spray pattern improves the uniform mixing of the cooling water with the steam flow and thus optimizes the desuperheating effect per unit mass of cooling water.

In operation, the flow of superheated steam enters the steam pipe 12 at the steam inlet 14, as shown in FIG. 1. The superheated steam then enters the barrel section 28 of the diffuser 26. Because the end plate 30 of the diffuser 26 seals the barrel section 28, the superheated steam is forced through the orifices 32 in the barrel section 28. Advantageously, because the area of the steam inlet 14 is greater than that of the combined area of the orifices 32 in the barrel section 28, the velocity of the superheated steam increases as it passes through the orifices 32 into the annular chamber 34. As was mentioned above, the selection of the shape, size, configuration and quantity of orifices 32 that may be incorporated within the barrel section 28 is dependent on the desired characteristics of the superheated steam flow as it passes into the annular chamber 34. The vortex ring 36 imparts a spiraling motion to the flow of superheated steam as it exits the annular chamber 34. The vanes 38 formed circularly around the vortex ring 36 may direct the flow of superheated steam into a spiraling motion. The end plate 30 creates the low pressure area 44 of the closed vortex 46 in the area immediately adjacent the exterior side of the end plate 30.

The combination of the spiraling motion imparted to the superheated steam by the vortex ring 36, the radially outwardly directed flow with increased velocity as produced by the diffuser 26, and the low pressure area 44 produced by the end plate 30 causes the superheated steam flowing from the vortex ring 36 to turbulently rotate in a spiraling, swirling flow of eddies and vortices in the low pressure area 44. The spray nozzle 42 sprays cooling water into the swirling flow of superheated steam in the low pressure area 44. The cooling water feedline 20 provides a varying supply of cooling water to the spray nozzle 42, regulated by the control valve 18. The spray nozzle 42 produces a predetermined spray pattern as mentioned above. The combination of the swirling, turbulent flow adjacent the end plate 30 and the spray pattern of the cooling water promotes optimum dispersion and uniform mixing of the cooling water with the superheated steam for increased residence time and more effective evaporation of the cooling water for any given flow condition of superheated steam. Although the flow of superheated steam has an initially low velocity at the steam inlet 14, the localized increase in velocity combined with the turbulent, swirling flow and uniform mixing with the cooling water assures optimum efficiency of the desuperheating device 10 in uniformly and controllably regulating the temperature of the superheated steam flow.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A vortex generator of a desuperheating device for generating a closed vortex within a flow of superheated steam passing through a steam pipe, the steam pipe having a steam inlet and a steam outlet, the vortex generator comprising:

a diffuser concentrically disposed within the steam pipe adjacent the steam inlet for increasing the velocity of the superheated steam, the diffuser and the steam pipe defining an annular chamber therebetween;

a vortex ring concentrically disposed within the annular chamber for imparting a spiraling motion to the flow of superheated steam exiting the annular chamber; and a spray nozzle mounted on the steam pipe proximate the vortex ring for spraying cooling water into the flow of superheated steam.

2. The vortex generator of claim 1 wherein the diffuser includes a cylindrically configured barrel section and an end plate, the barrel section having a plurality of orifices formed thereabout, with the end plate being attached to and sealing one end of the barrel section such that the superheated steam passes through the orifices and into the annular chamber.

3. The vortex generator of claim 2 wherein the orifices radially extend through the barrel section of the diffuser.

4. The vortex generator of claim 3 wherein the orifices are arranged in a plurality of rows extending axially along a length of the barrel section.

5. The vortex generator of claim 4 wherein the rows are circumferentially spaced apart and each orifice in a row is substantially aligned in the axial direction with the orifice in an adjacent row.

6. The vortex generator of claim 4 wherein the rows are circumferentially spaced apart and each orifice in a row is offset in the axial direction from the orifice in an adjacent row.

7. The vortex generator of claim 2 wherein the orifices are of substantially identical circular shape.

8. The vortex generator of claim 1 wherein the vortex ring has an annular shape and is disposed proximate the end plate.

9. The vortex generator of claim 2 wherein the vortex ring includes a plurality of vanes formed circularly therearound, the vanes configured to impart a spiraling motion to the flow of superheated steam.

10. The vortex generator of claim 9 wherein:

the vanes extend radially from an exterior diameter of the barrel section; and the vanes, the steam pipe, and the barrel section collectively define corresponding channels configured to impart a spiral motion to the superheated steam such that the superheated steam exiting the annular chamber defines a helical path.

11. The vortex generator of claim 1 wherein the spray nozzle is disposed approximately midway between the vortex ring and the end of the closed vortex.

12. The vortex generator of claim 1 wherein the spray nozzle imparts a predetermined spray pattern to the cooling water.

13. The vortex generator of claim 12 wherein the spray nozzle imparts a conical spiraling motion to the predetermined spray pattern such that the cooling water exiting the spray nozzle defines an expanding helical path.

* * * * *